US011717024B2

(12) United States Patent
Novak, III et al.

(10) Patent No.: US 11,717,024 B2
(45) Date of Patent: Aug. 8, 2023

(54) APPARATUS FOR INSERTING MICROCAPSULE OBJECTS INTO A FILTER ELEMENT OF A SMOKING ARTICLE, AND ASSOCIATED METHOD

(71) Applicant: R.J. Reynolds Tobacco Company, Winston-Salem, NC (US)

(72) Inventors: Charles Jacob Novak, III, Winston-Salem, NC (US); Vernon Brent Barnes, Advance, NC (US); Robert William Benford, Kernersville, NC (US); Margarette Elisa Lovette, Winston-Salem, NC (US); Quentin Paul Guenther, Jr., Winston-Salem, NC (US); Jerry Wayne Pipes, Clemmons, NC (US); William Robert Collett, Lexington, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 332 days.

(21) Appl. No.: 16/682,787

(22) Filed: Nov. 13, 2019

(65) Prior Publication Data

US 2020/0077695 A1 Mar. 12, 2020

Related U.S. Application Data

(62) Division of application No. 13/248,847, filed on Sep. 29, 2011, now abandoned.

(51) Int. Cl.
*A24D 3/02* (2006.01)

(52) U.S. Cl.
CPC ..... *A24D 3/0216* (2013.01)

(58) Field of Classification Search
CPC ..... A24D 3/0216
USPC ..... 493/39
See application file for complete search history.

(56) References Cited

U.S. PATENT DOCUMENTS

| | | | |
|---|---|---|---|
| 2,246,107 | A | 6/1941 | Ruau |
| 3,288,147 | A | 11/1966 | Molins et al. |
| 3,301,454 | A | 1/1967 | Wayne et al. |
| 3,308,600 | A | 3/1967 | Erdmann et al. |
| 3,366,121 | A | 1/1968 | Carty |
| 3,390,039 | A | 6/1968 | Caughman et al. |

(Continued)

FOREIGN PATENT DOCUMENTS

| | | |
|---|---|---|
| DE | 10238906 | 3/2004 |
| DE | 10 2008 062 370 | 6/2010 |

(Continued)

OTHER PUBLICATIONS

Davis et al., *Tobacco Production, Chemistry and Technology*, 1999, pp. 440-460, Blackwell Science, Inc., Malden, MA.

(Continued)

*Primary Examiner* — Chinyere J Rushing-Tucker
(74) *Attorney, Agent, or Firm* — Womble Bond Dickinson (US) LLP

(57) ABSTRACT

An apparatus is provided for forming a cigarette filter rod member defining a longitudinal axis. A rod-forming unit is configured to form a continuous supply of a filter material into a continuous cylindrical rod member. An insertion unit configured to insert a carrier carrying a plurality of frangible microcapsule objects into the rod member. Associated apparatuses and methods are also provided.

4 Claims, 10 Drawing Sheets

FIG. 5

(56) References Cited

U.S. PATENT DOCUMENTS 3,398,675 A 8/1968 Potter et al.
3,424,172 A 1/1969 Neurath
3,428,049 A 2/1969 Leake et al.
3,444,517 A 5/1969 Rabinow
3,550,508 A 12/1970 Wartman, Jr.
3,550,598 A 12/1970 McGlumphy
3,575,276 A 4/1971 Rupert
3,602,231 A 8/1971 Dock
3,685,521 A 8/1972 Dock
3,818,223 A 6/1974 Gibson et al.
3,884,246 A 5/1975 Walker
3,915,176 A 10/1975 Heitmann et al.
4,053,056 A 10/1977 Day
4,083,460 A 4/1978 Venturi
4,171,739 A 10/1979 Yamato
4,174,719 A 11/1979 Martin et al.
4,238,993 A 12/1980 Brand et al.
4,280,187 A 7/1981 Reuland et al.
4,281,670 A 8/1981 Heitmann et al.
4,281,671 A 8/1981 Byrne et al.
4,284,088 A 8/1981 Brand et al.
4,291,713 A 9/1981 Frank
4,294,353 A 10/1981 Focke et al.
RE30,964 E 6/1982 Butner et al.
4,403,620 A 9/1983 Joseph et al.
4,445,520 A 5/1984 Knight et al.
4,474,190 A 10/1984 Brand
4,509,568 A 4/1985 Kawaguchi et al.
4,534,463 A 8/1985 Bouchard
4,574,816 A 3/1986 Rudszinat
4,715,497 A 12/1987 Focke et al.
4,736,754 A 4/1988 Heitmann et al.
4,781,203 A 11/1988 La Hue
4,807,809 A 2/1989 Pryor et al.
4,811,745 A 3/1989 Cohen et al.
4,844,100 A 7/1989 Holznagel
4,850,301 A 7/1989 Greene, Jr. et al.
4,852,734 A 8/1989 Allen et al.
4,862,905 A 9/1989 Green, Jr. et al.
4,878,506 A 11/1989 Pinck et al.
4,889,144 A 12/1989 Tateno et al.
4,920,990 A 5/1990 Lawrence et al.
4,925,602 A 5/1990 Hill et al.
5,012,823 A 5/1991 Keritsis et al.
5,012,829 A 5/1991 Thesing et al.
5,025,814 A 6/1991 Raker
5,060,664 A 10/1991 Siems et al.
5,060,665 A 10/1991 Heitmann
5,074,320 A 12/1991 Jones, Jr. et al.
5,101,609 A 4/1992 Cook
5,101,839 A 4/1992 Jakob et al.
5,105,838 A 4/1992 White et al.
5,131,416 A 7/1992 Gentry
5,139,140 A 8/1992 Burrows et al.
5,156,169 A 10/1992 Holmes et al.
5,159,944 A 11/1992 Arzonico et al.
5,167,244 A 12/1992 Kjerstad
5,191,906 A 3/1993 Myracle, Jr.
5,220,930 A 6/1993 Gentry
5,225,277 A 7/1993 Takegawa et al.
5,240,117 A 8/1993 Focke et al.
5,271,419 A 12/1993 Arzonico et al.
5,333,729 A 8/1994 Wolfe
5,353,357 A 10/1994 Longest et al.
5,360,023 A 11/1994 Blakeley et al.
5,387,285 A 2/1995 Rivers
5,396,909 A 3/1995 Gentry et al.
5,432,600 A 7/1995 Grollimund et al.
5,472,002 A 12/1995 Covarrubias
5,476,108 A 12/1995 Dominguez et al.
5,515,159 A 5/1996 Sites et al.
5,542,901 A 8/1996 Atwell
5,588,068 A 12/1996 Longest et al.
5,660,382 A 8/1997 Meier
5,718,250 A 2/1998 Banerjee et al.
5,740,902 A 4/1998 Spatafora
5,875,824 A 3/1999 Atwell et al.
5,898,104 A 4/1999 Rohrssen et al.
5,938,018 A 8/1999 Keaveney et al.
5,977,780 A 11/1999 Herrmann
6,020,969 A 2/2000 Struckhoff et al.
6,054,665 A 4/2000 Focke et al.
6,117,455 A 9/2000 Takada et al.
6,158,193 A 12/2000 Focke et al.
6,213,128 B1 4/2001 Smith et al.
6,229,115 B1 5/2001 Vos et al.
6,246,778 B1 6/2001 Moore
6,360,751 B1 3/2002 Fagg et al.
6,373,520 B1 4/2002 Cadieux, Jr. et al.
6,384,359 B1 5/2002 Belcastro et al.
6,385,333 B1 5/2002 Puckett et al.
6,437,317 B1 8/2002 Focke et al.
6,537,186 B1 3/2003 Veluz
6,612,429 B2 9/2003 Dennen
6,647,878 B2 11/2003 Blau et al.
6,726,006 B1 4/2004 Funderburk et al.
6,736,261 B1 5/2004 Thomas et al.
6,761,174 B2 7/2004 Jupe et al.
6,779,530 B2 8/2004 Kraker
6,813,961 B2 11/2004 Stiller et al.
6,848,449 B2 2/2005 Kitao et al.
6,904,917 B2 6/2005 Kitao et al.
7,074,170 B2 7/2006 Lanier, Jr. et al.
7,115,085 B2 10/2006 Deal
7,210,486 B2 5/2007 Hartmann
7,234,271 B1 6/2007 Fitzgerald et al.
7,237,559 B2 7/2007 Ashcraft et al.
7,240,678 B2 7/2007 Crooks et al.
7,275,548 B2 10/2007 Hancock et al.
7,281,540 B2 10/2007 Barnes et al.
7,296,578 B2 11/2007 Read, Jr.
7,325,382 B2 2/2008 Nelson et al.
7,381,175 B2 6/2008 Dawson et al.
7,434,585 B2 10/2008 Holmes
7,479,098 B2 1/2009 Thomas et al.
7,565,818 B2 7/2009 Thomas et al.
7,578,298 B2 8/2009 Karles et al.
7,654,945 B2 2/2010 Deal
7,740,019 B2 6/2010 Nelson et al.
7,744,922 B2 6/2010 Mane et al.
7,784,356 B2 8/2010 Spiers et al.
7,784,357 B2 8/2010 Spiers et al.
7,833,146 B2 11/2010 Deal
7,836,895 B2 11/2010 Dube et al.
7,861,728 B2 1/2011 Holton, Jr. et al.
7,972,254 B2 7/2011 Stokes et al.
8,142,339 B2 3/2012 Deal
8,186,359 B2 5/2012 Ademe et al.
8,262,550 B2 9/2012 Barnes et al.
8,308,623 B2 11/2012 Nelson et al.
2001/0032932 A1 10/2001 Focke et al.
2002/0185141 A1 12/2002 Heide
2003/0136419 A1 7/2003 Muller
2003/0137312 A1 7/2003 Cerati et al.
2003/0145866 A1 8/2003 Hartmann
2003/0178036 A1 9/2003 Demmer et al.
2003/0206023 A1 11/2003 Herrmann
2004/0129281 A1 7/2004 Hancock et al.
2004/0141174 A1 7/2004 Focke et al.
2004/0217023 A1 11/2004 Fagg et al.
2004/0256253 A1 12/2004 Henson et al.
2004/0261807 A1 12/2004 Dube et al.
2005/0016556 A1 1/2005 Ashcraft et al.
2005/0039764 A1 2/2005 Barnes et al.
2005/0066986 A1 3/2005 Nestor et al.
2005/0075754 A1 4/2005 Zeitler et al.
2005/0076929 A1 4/2005 Fitzgerald et al.
2005/0112228 A1 5/2005 Smith et al.
2005/0147711 A1 7/2005 Walter et al.
2005/0150786 A1 7/2005 Mitten et al.
2006/0169295 A1 8/2006 Draghetti
2006/0207616 A1 9/2006 Hapke et al.
2006/0243611 A1 11/2006 Wu
2006/0272655 A1 12/2006 Thomas et al.

(56) References Cited

U.S. PATENT DOCUMENTS

| | | | | |
|---|---|---|---|---|
| 2007/0056600 | A1 | 3/2007 | Coleman, III et al. | |
| 2007/0068540 | A1 | 3/2007 | Thomas et al. | |
| 2007/0091326 | A1 | 4/2007 | Schroeder et al. | |
| 2007/0102015 | A1 | 5/2007 | Villarinho | |
| 2007/0144542 | A1 | 6/2007 | Bencivenni et al. | |
| 2007/0215167 | A1 | 9/2007 | Crooks et al. | |
| 2007/0246055 | A1 | 10/2007 | Oglesby | |
| 2008/0029118 | A1 | 2/2008 | Nelson et al. | |
| 2008/0093234 | A1 | 4/2008 | Jones et al. | |
| 2008/0099353 | A1 | 5/2008 | Parsons et al. | |
| 2008/0142028 | A1 | 6/2008 | Fagg | |
| 2008/0179204 | A1 | 7/2008 | Lutzig | |
| 2008/0190439 | A1 | 8/2008 | Veluz et al. | |
| 2008/0202540 | A1 | 8/2008 | Carter et al. | |
| 2009/0050163 | A1 | 2/2009 | Hartmann et al. | |
| 2009/0066948 | A1 | 3/2009 | Karpowicz et al. | |
| 2009/0090372 | A1 | 4/2009 | Thomas et al. | |
| 2009/0120449 | A1 | 5/2009 | Tindall | |
| 2009/0194118 | A1 | 8/2009 | Ademe et al. | |
| 2010/0059069 | A1 | 3/2010 | Boldrini | |
| 2010/0059074 | A1 | 3/2010 | Brantley et al. | |
| 2010/0101589 | A1* | 4/2010 | Nelson | A24D 3/0216 131/84.4 |
| 2010/0184576 | A1 | 7/2010 | Prestia et al. | |
| 2010/0236561 | A1 | 9/2010 | Barnes et al. | |
| 2010/0293106 | A1 | 11/2010 | Rhoads et al. | |
| 2010/0294290 | A1 | 11/2010 | Zhang | |
| 2011/0053745 | A1 | 3/2011 | Iliev et al. | |
| 2011/0067976 | A1 | 3/2011 | Pelagatti | |
| 2011/0162662 | A1 | 7/2011 | Nikolov et al. | |
| 2011/0162665 | A1 | 7/2011 | Burov et al. | |
| 2011/0169942 | A1 | 7/2011 | Brantley et al. | |
| 2011/0190105 | A1* | 8/2011 | Fallon | A24D 3/0212 493/39 |
| 2011/0230320 | A1 | 9/2011 | Stokes et al. | |
| 2011/0271968 | A1 | 11/2011 | Carpenter et al. | |
| 2011/0277878 | A1 | 11/2011 | Williams | |
| 2012/0037546 | A1 | 2/2012 | Dixon et al. | |
| 2012/0055493 | A1 | 3/2012 | Novak, III et al. | |
| 2012/0077658 | A1 | 3/2012 | Nikolov et al. | |
| 2012/0080043 | A1 | 4/2012 | Naenen et al. | |
| 2012/0120229 | A1 | 5/2012 | Brantley et al. | |
| 2012/0245006 | A1 | 9/2012 | Henley et al. | |
| 2012/0245007 | A1 | 9/2012 | Henley et al. | |
| 2013/0096711 | A1 | 4/2013 | Gates et al. | |
| 2014/0263408 | A1 | 9/2014 | Amiss | |

FOREIGN PATENT DOCUMENTS

| | | | |
|---|---|---|---|
| EP | 0 292 949 | A2 | 11/1988 |
| EP | 0 704 172 | | 4/1996 |
| EP | 1 669 755 | | 6/2006 |
| EP | 1 754 419 | A1 | 2/2007 |
| EP | 1 767 107 | | 3/2007 |
| EP | 1 916 188 | | 4/2008 |
| EP | 2 243 384 | A1 | 10/2010 |
| GB | 1058343 | A2 | 2/1967 |
| GB | 2 020 158 | | 11/1979 |
| GB | 1042000 | | 9/1996 |
| JP | 9325123 | | 12/1997 |
| JP | 2001-190262 | | 7/2001 |
| JP | 2003-219855 | | 8/2003 |
| JP | 2004-504825 | | 2/2004 |
| WO | WO 03/009711 | A1 | 2/2003 |
| WO | WO 03/047836 | | 6/2003 |
| WO | WO 03/082558 | | 10/2003 |
| WO | WO 2004/056221 | | 7/2004 |
| WO | WO 2005/113386 | | 12/2005 |
| WO | WO 2006/064371 | | 6/2006 |
| WO | WO 2006/092962 | | 9/2006 |
| WO | WO 2007/028957 | | 3/2007 |
| WO | WO 2007/038053 | | 4/2007 |
| WO | WO 2009/143338 | | 11/2009 |

OTHER PUBLICATIONS

Johnson, *Development of Cigarette Components to Meet Industry Needs*, 52nd T.S.R.C., Sep. 1998.

* cited by examiner

FIG. 10
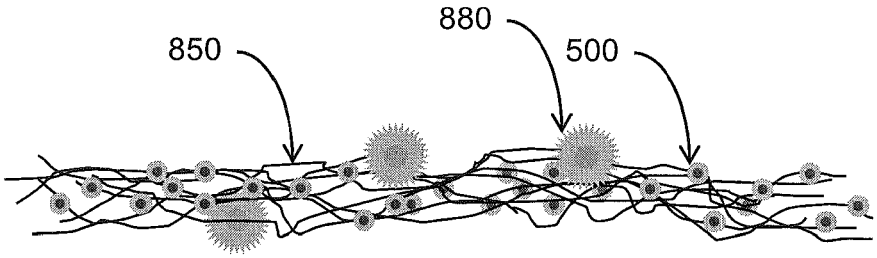
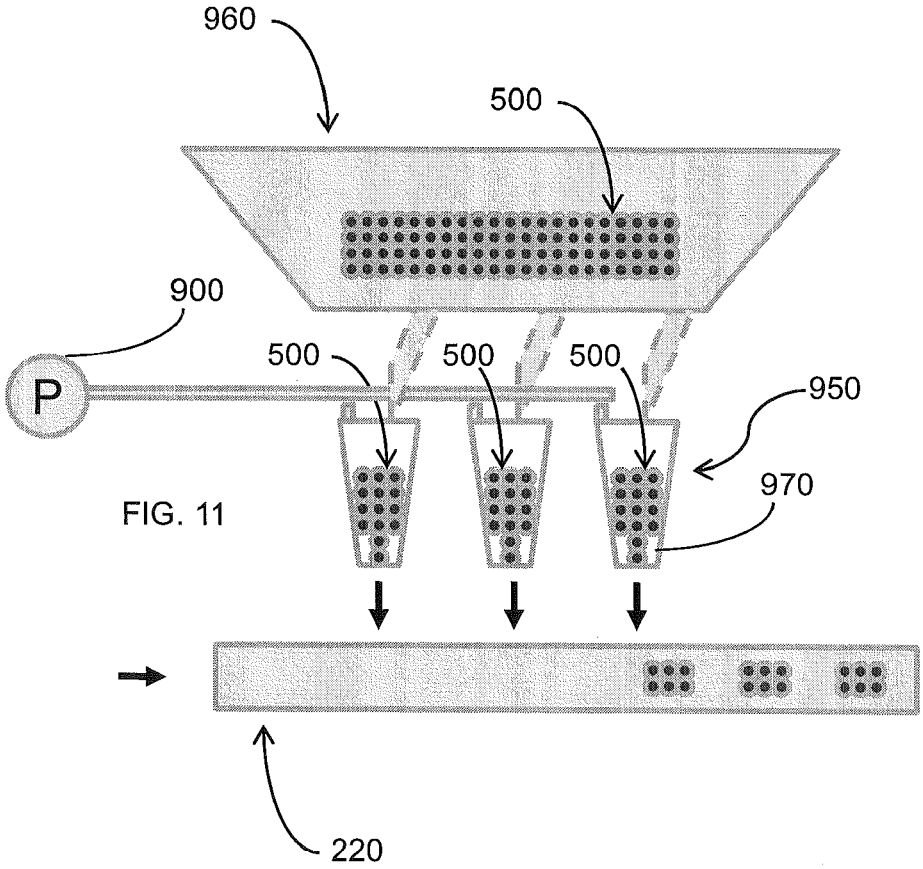
FIG. 11

APPARATUS FOR INSERTING MICROCAPSULE OBJECTS INTO A FILTER ELEMENT OF A SMOKING ARTICLE, AND ASSOCIATED METHOD

CROSS-REFERENCE TO RELATED APPLICATIONS

This application is a Divisional of U.S. application Ser. No. 13/248,847, filed on Sep. 29, 2011, which application is hereby incorporated by reference in its entirety in this application.

BACKGROUND OF THE DISCLOSURE

Field of the Disclosure

The present disclosure relates to filter elements of smoking articles and associated formation methods. In particular, aspects of the present disclosure relate to apparatuses and methods for inserting microcapsule objects into a filter element of a smoking article.

Description of Related Art

Cigarettes, cigars and pipes are popular smoking articles that employ tobacco in various forms. Such smoking articles are used by heating or burning tobacco, and aerosol (e.g., smoke) is inhaled by the smoker. In some instances, such smoking articles may include a filter element engaged with the tobacco rod portion thereof, wherein the filter element is generally configured to be held by the mouth of the user and to affect or otherwise alter the characteristics of the smoke inhaled by the smoker.

In so altering the characteristics of the smoke inhaled by the smoker, the filter element may include one or more breakable capsules, such as liquid-filled, flavor-containing capsules disposed therein. Various components of such filter elements, as well as equipment and techniques for manufacturing such filter elements, are set forth, for example, in U.S. Pat. No. 7,972,254 to Stokes et al.; U.S. Pat. No. 7,479,098 to Thomas et al.; U.S. Pat. No. 7,833,146 to Deal and U.S. Pat. No. 7,836,895 to Dube et al.; U.S. Pat. App. Publ. Nos. 2008/0142028 to Fagg; 2009/0050163 to Hartmann et al.; 2009/0090372 to Thomas et al.; 2010/0184576 to Prestia et al.; 2010/0236561 to Barnes et al.; 2011/0053745 to Iliev et al.; and PCT Application Pub. No. WO 03/009711 to Kim; which are incorporated herein by reference. Exemplary capsules can be of the type employed commercially in cigarettes marketed under the brand name Camel Crush by R. J. Reynolds Tobacco Company.

A representative capsule is generally spherical in shape, and has an outer cover or shell that contains a liquid center region. The liquid center region, which contains a flavorant that is released when the outer shell undergoes some type of physical destruction, breakage, or other loss of physical integrity (e.g., through dispersion, softening, crushing, application of pressure, or the like), thereby provides for altering the sensory properties of the mainstream smoke passing through the filter element. The flavoring agent can also be released through degradation during smoking, such as for example, degradation due to action of moisture in smoke upon the materials of the outer shell of the capsule. As used herein, a flavor agent member is an object containing a flavoring ingredient (as used herein, the terms "flavorant," "flavoring ingredient," or "flavoring agent" refer to substances, such as liquids or solids, that provide a concentrated release for a sensory effect such as, for example, taste, mouth feel, moistness, coolness/heat, and/or fragrance/aroma). Other ingredients that can be incorporated into the capsules or the filter elements of the disclosure are set forth, for example, in U.S. Pat. No. 4,889,144 to Tateno et al.

The capsule payload can have a form that can vary; and typically, the payload has the form of a liquid, a gel, or a solid (e.g., a crystalline material or a dry powder). The payload can incorporate components that aid in flavoring or scenting mainstream cigarette smoke. Alternatively, the payload may be a breath freshening agent for the smoker, a deodorizing agent for the cigarette butt, a moistening or cooling agent for the cigarette smoke, or a composition capable of otherwise altering the nature or character of the cigarette.

The size and weight of each capsule may vary depending upon the desired properties it is to impart to the cigarette. Certain types of capsules are generally spherical in shape. However, suitable capsules may have other types of shapes, such as generally rectilinear, oblong, elliptical, or oval shapes. Exemplary generally spherical capsules have diameters of less than about 3.5 mm, generally less than about 1.5 mm, often less than about 1 mm, and frequently less than about 0.5 mm. For example, several capsules can be employed, and those capsules can be in the range of about 0.25 mm to about 2 mm in diameter. A plurality of very small capsules, commonly referred to as "microcapsules," can be incorporated within the filter element. Certain microcapsules can be described as granular in size and are barely visible to the naked eye. Exemplary microcapsules may have diameters of less than about 100 microns, such as capsules having diameters in the range of about 1 to about 40 microns, or about 1 micron to about 20 microns. The total weight of the capsules contained within the filter may vary, but is typically greater than about 10 mg, often greater than about 20 mg, and can be greater than about 30 mg. The total weight of the capsules is typically less than about 200 mg, often less than about 100 mg, and can be less than 50 mg.

Microcapsules have been widely commercially available, and exemplary types of microcapsule technologies are of that type set forth in Gutcho, Microcapsules and Microencapsulation Techniques (1976); Gutcho, Microcapsules and Other Capsules Advances Since 1975 (1979); Kondo, Microcapsule Processing and Technology (1979); Iwamoto et al., AAPS Pharm. Sci. Tech. 2002 3(3): article 25; U.S. Pat. No. 3,550,598 to McGlumphy; U.S. Pat. No. 4,889,144 to Tateno et al.; U.S. Pat. No. 6,117,455 to Takada et al.; U.S. Pat. No. 6,612,429 to Dennen; and U.S. Pat. No. 7,578,298 to Karles et al.; each of which is incorporated herein by reference. Suitable types of microcapsules are available from sources such as Microtech Laboratories of Dayton, Ohio. See also the exemplary capsules of the type disclosed in U.S. Pat. No. 7,836,895 to Dube et al. and U.S. Pat. No. 7,861,728 to Holton, Jr. et al.; U.S. Pat. Appl. Pub. No. 2008/0142028 to Fagg; and U.S. patent application Ser. No. 12/775,892, to Carpenter et al., filed May 7, 2010; each of which are incorporated herein by reference.

The number of capsules that is incorporated into the filter element can vary. The precise number can vary, depending upon factors such as the size of the capsules, the character or nature of the flavoring agent, the positioning of the capsules within the filter element, and the like. The number of capsules incorporated within the relevant region of the filter element can exceed about 5, can exceed about 10, can exceed about 20, can exceed about 40, and can even exceed about 100. In certain embodiments, the number of capsules can be greater than about 500, and even greater than about 1,000. Larger numbers of capsules in certain embodiments can be advantageous because it can provide the smoker with increased control over flavor release. As opposed to a filter containing a single capsule, the presence of a plurality of capsules allows the smoker to vary the flavor release by continued manipulation of the filter, thereby crushing more capsules and releasing additional flavoring agent.

However, if such capsules are inserted into the filter element of the smoking article during mass production thereof, difficulties may be encountered in relation to the size of the capsules being employed. That is, mass production of cigarettes or other smoking articles may be a high speed process, often requiring dynamic motion of the product and/or the associated manufacturing equipment. As such, as the capsules get smaller and more numerous (i.e., on the order of a microcapsule), the more difficult it becomes to insert the capsules into the respective filter elements cleanly, efficiently, and without damage to the capsules themselves.

As such, there exists a need for a method of inserting microcapsule objects into the filter element of a smoking article, wherein the insertion can be accomplished efficiently and cleanly, for example, without loss or spillage of the micro capsules, and while providing consistent metering of the amount of microcapsules inserted into such filter elements. In addition, such a method should also preferably be capable of implementing the microcapsule insertion process without causing damage to the microcapsules, or at least should be capable of detecting whether any microcapsules were damaged during the insertion process. It would also be desirable to have an associated apparatus capable of implementing the desired method.

BRIEF SUMMARY OF THE DISCLOSURE

The above and other needs are met by aspects of the present disclosure which, in one aspect, provides an apparatus for forming a cigarette filter rod member defining a longitudinal axis. Such an apparatus comprises a rod-forming unit configured to form a continuous supply of a filter material into a continuous cylindrical rod member; and an insertion unit configured to insert a carrier carrying a plurality of frangible microcapsule objects into the rod member.

A representative microcapsule object is generally spherical in shape, and has an outer cover or shell that may contain a liquid center region. The liquid center region, which is released when the outer shell undergoes some type of physical destruction, breakage, or other loss of physical integrity (e.g., through dispersion, softening, crushing, application of pressure, or the like), is thereby capable of altering the sensory properties of the smoke drawn through the filter element in which the microcapsule objects are inserted. In some instances, certain microcapsule objects are generally spherical and are less than about 100 microns in diameter. A preferred diameter range may be between about 1 and about 40 microns, with between about 1 and about 20 microns in diameter being most preferred in some instances.

The filter element of the smoking article is intended to be placed in the mouth of the smoking article user, such that the tobacco formulation within the tobacco rod attached to the opposed end of the filter element may be lit and enjoyed by the user. During use of the smoking article product, the outer shell of one or more of the microcapsules within the filter element may be, for example, acted upon by moisture within the mouth of the user, broken, crushed, or otherwise acted upon to release the contents thereof such that the contents are exposed to the smoke drawn through the filter element by the user.

Another aspect of the present disclosure relates to a method of forming a cigarette filter rod member defining a longitudinal axis. Such a method comprises forming a continuous supply of a filter material into a continuous cylindrical rod member using a rod-forming unit; and inserting a carrier carrying a plurality of frangible microcapsule objects into the rod member using an insertion unit. In some aspects, the insertion unit may be further configured to insert a continuous supply of the carrier carrying the microcapsule objects into the continuous supply of a filter material such that the continuous rod member includes the carrier and associated microcapsule objects therein. In this regard, other aspects of the present disclosure are directed to an apparatus and method for engaging the microcapsule objects with the carrier, wherein the carrier may be configured to facilitate insertion of the microcapsule objects into a filter rod and, in some instances, formation of individual filter elements and associated smoking articles therefrom.

That is, the apparatus may further comprise an insert forming unit configured to engage the microcapsule objects with the carrier and/or to engage a discrete group of the microcapsule objects with a respective discrete unit of the carrier. In some instances, the insert forming unit is further configured to engage discrete groups of the microcapsule objects with a continuous supply of the carrier such that the groups are regularly spaced apart therealong. Such a carrier may comprise, for example, one of a pouch member, a capsule member, a cartridge member, a strand, a tubular member, a continuous elongate member, a carrier matrix, a continuous strip member, a continuous corrugated member, and combinations thereof. If necessary or desired, a releasing unit may be provided and configured to release the microcapsule objects from the carrier, once the carrier and associated microcapsule objects are disposed within the rod member. Such a releasing unit may be further configured to, for example, one of dissolve, disintegrate, and degrade the carrier to release the microcapsule objects therefrom and into the filter element. In order to determine whether any of the microcapsule objects may have been damaged before or during the insertion process, some aspects may comprise an inspection unit arranged to inspect the rod member having the carrier and microcapsule objects therein, wherein the inspection unit may be configured to determine whether the frangible microcapsule objects have remained intact upon insertion into the rod member. Such an inspection unit may comprise, for example, a moisture sensor.

Other aspects of the present disclosure may comprise an apparatus and associated method for forming a cigarette filter rod member defining a longitudinal axis. In such instances, a rod-forming unit may configured to form a continuous supply of a filter material into a continuous cylindrical rod member, and an insertion unit may be configured to introduce a plurality of frangible microcapsule objects directly into the rod member at discrete locations therealong.

Accordingly, aspects of the present disclosure are particularly configured to provide microcapsule objects and to place discrete groups of such microcapsule objects within a continuous cigarette filter rod member, at discrete locations therealong, such that a desired arrangement of a discrete group of at least a portion of a plurality of microcapsule objects per cigarette filter element portion of the rod member is obtained when the continuous cigarette filter rod member is subdivided to form discrete filter element portions.

Aspects of the present disclosure thus provide advantages as otherwise detailed herein.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

Figure 3:
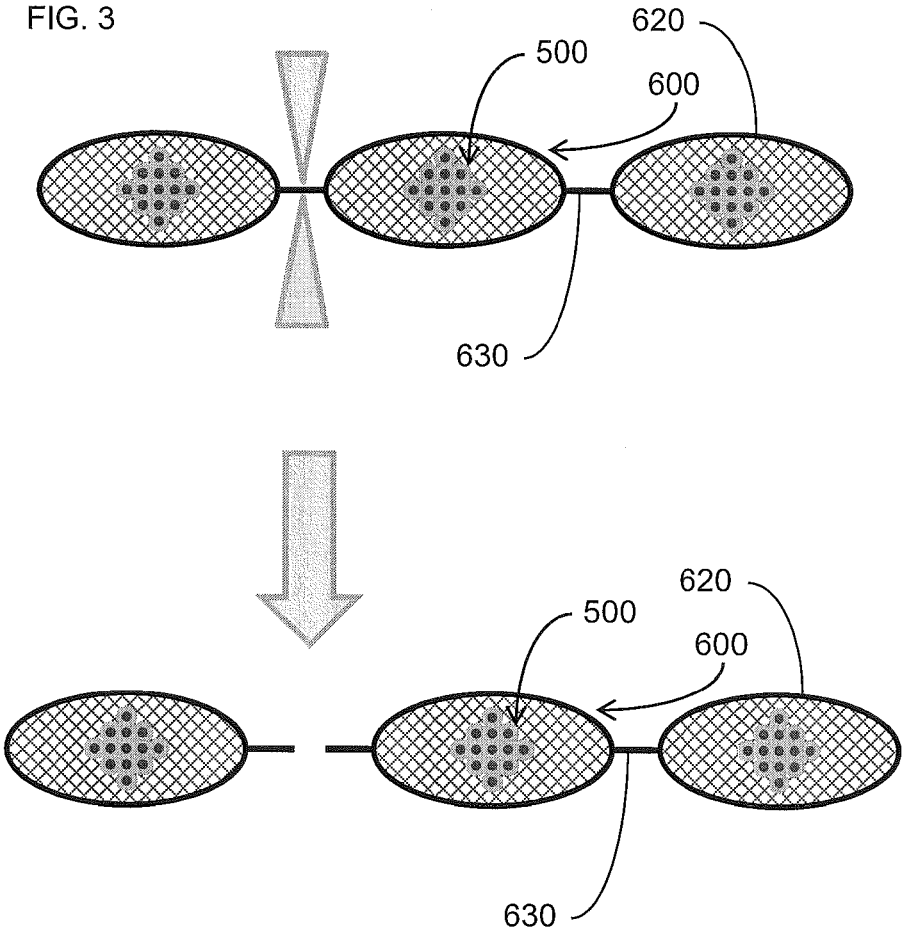
Figure 4:
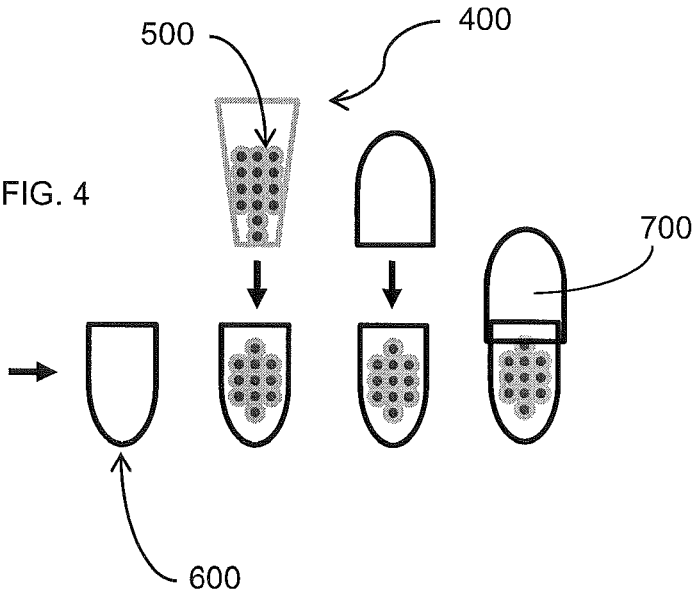
Figure 5:
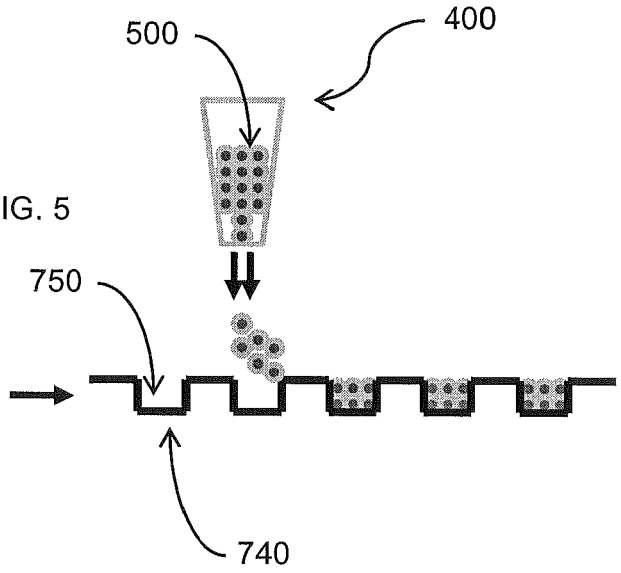
Figure 6:
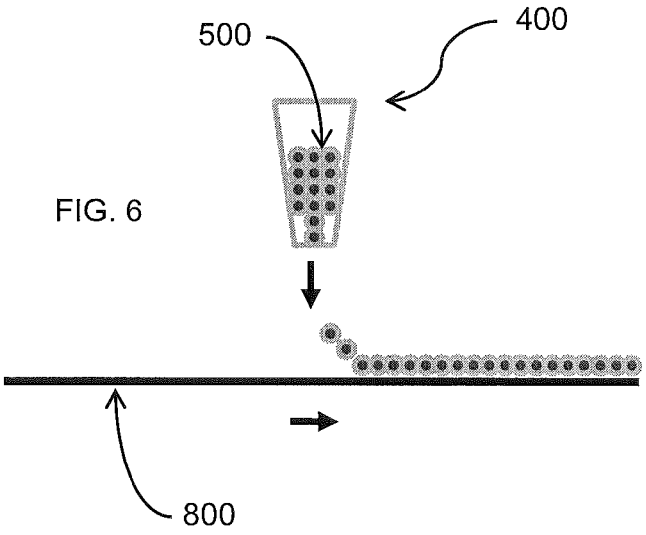
Figure 7:
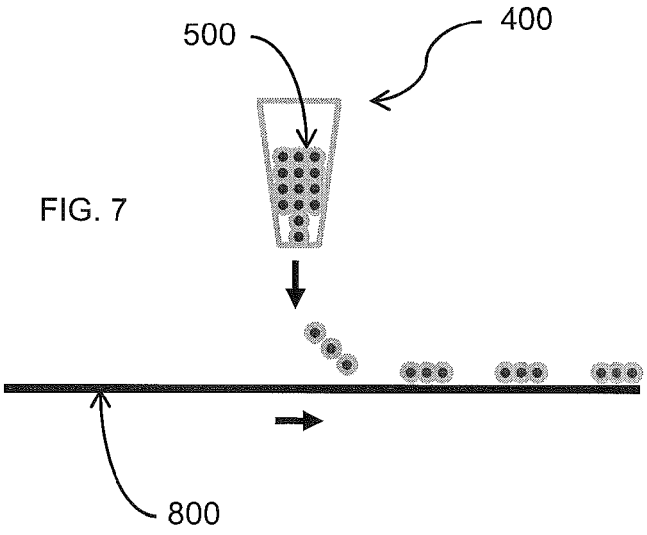
Figure 8:
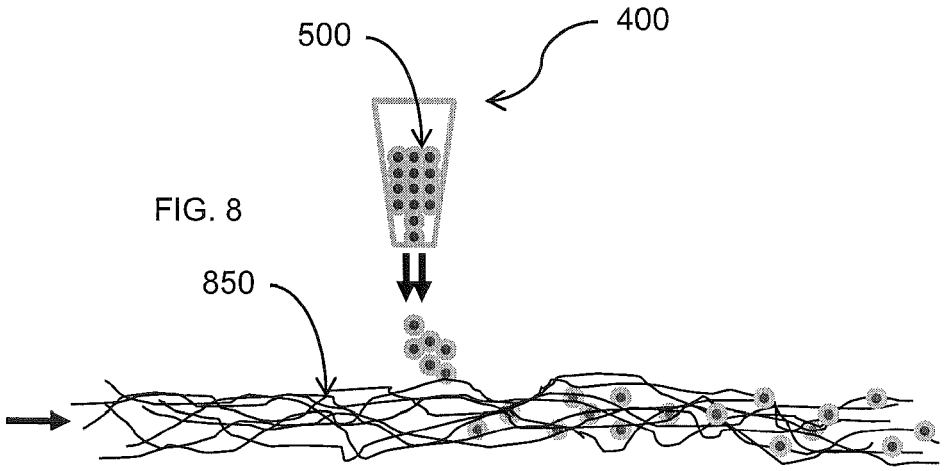
Figure 9:
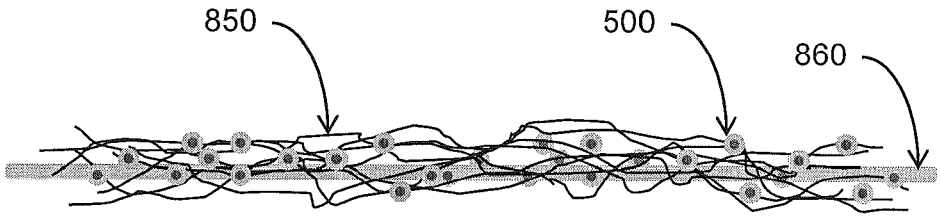
Figure 9A:
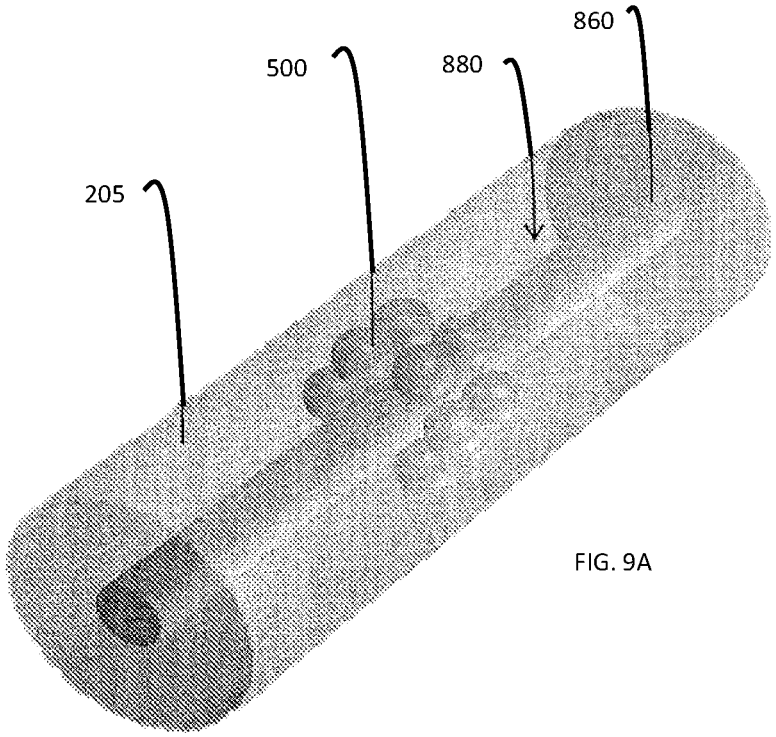
Figure 9B:
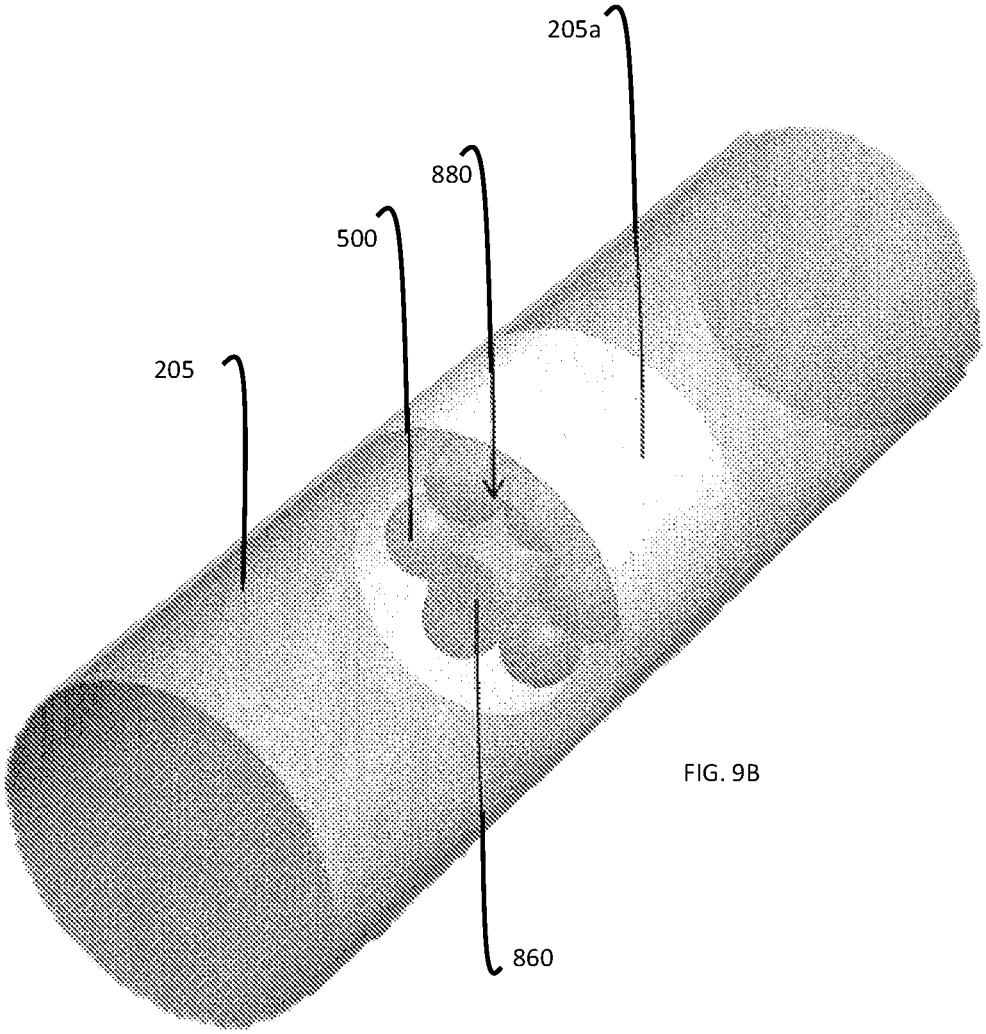

FIG. 3 is another schematic of a continuous carrier having at least a portion of a plurality of microcapsule objects associated therewith at discrete, spaced apart intervals therealong, being severed between the discrete intervals, so as to provide a plurality of discrete pouches or compartments holding the microcapsule objects, according to one aspect of the present disclosure, for individual insertion into a continuous filter rod element of a smoking article;

FIG. 4 is a schematic of an insert forming unit configured to associate at least a portion of a plurality of microcapsule objects with a carrier, for insertion thereof into a continuous filter rod element of a smoking article, according to one embodiment of the present disclosure, wherein the carrier comprises a capsule or cartridge;

FIG. 5 is a schematic of an insert forming unit configured to associate at least a portion of a plurality of microcapsule objects with a carrier, for insertion thereof into a continuous filter rod element of a smoking article, according to one embodiment of the present disclosure, wherein the carrier comprises a corrugated member;

FIG. 6 is a schematic of an insert forming unit configured to associate at least a portion of a plurality of microcapsule objects with a carrier, for insertion thereof into a continuous filter rod element of a smoking article, according to one embodiment of the present disclosure, wherein the carrier comprises a sheet member or a strand member, and the microcapsule objects are continuously associate therewith along the length thereof;

FIG. 7 is a schematic of an insert forming unit configured to associate at least a portion of a plurality of microcapsule objects with a carrier, for insertion thereof into a continuous filter rod element of a smoking article, according to one embodiment of the present disclosure, wherein the carrier comprises a sheet member or a strand member, and the microcapsule objects are associate therewith at discrete intervals along the length thereof;

FIG. 8 is a schematic of an insert forming unit configured to associate at least a portion of a plurality of microcapsule objects with a carrier, for insertion thereof into a continuous filter rod element of a smoking article, according to one embodiment of the present disclosure, wherein the carrier comprises a web member;

FIG. 9 is a schematic of the web member of FIG. 8, having at least a portion of a plurality of microcapsule objects associated therewith, according to one embodiment of the present disclosure, wherein such a web member is engaged with a continuous elongate rod member for providing support therefor;

FIGS. 9A and 9B are schematics of exemplary filter elements of a smoking article, having a rupture-facilitating device for facilitating rupture of the microcapsule objects by the user, according to one embodiment of the present disclosure, wherein such a rupture-facilitating device comprises an elongate rod member extending through an entire filter element or a segment thereof, respectively;

FIG. 10 is a schematic of the web member of FIG. 8, having at least a portion of a plurality of microcapsule objects associated therewith, according to one embodiment of the present disclosure, wherein such a web member further includes a rupture-facilitating device for facilitating rupture of the microcapsule objects by the user; and FIG. 11 is a schematic of an apparatus for inserting a plurality of microcapsule objects directly into the continuous filter rod element of a smoking article, according to one aspect of the present disclosure.

Figure 12:
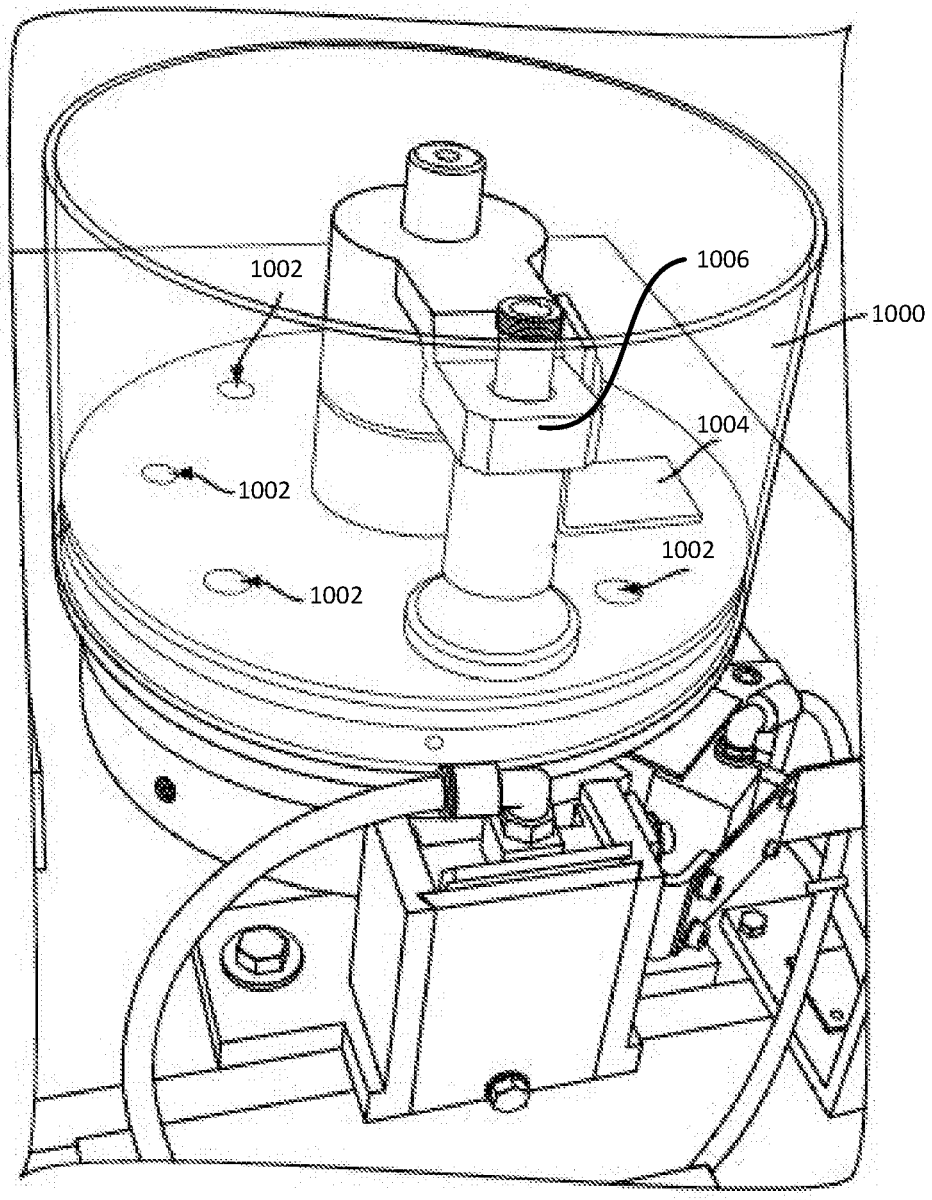

FIG. 12 is a perspective view of a microcapsule repository defining a plurality of cavities according to one embodiment of the present disclosure, wherein such a microcapsule repository includes a rotatable arm member within the repository.

DETAILED DESCRIPTION OF THE DISCLOSURE

The present disclosure now will be described more fully hereinafter with reference to the accompanying drawings, in which some, but not all aspects of the disclosure are shown. Indeed, this disclosure may be embodied in many different forms and should not be construed as limited to the aspects set forth herein; rather, these aspects are provided so that this disclosure will satisfy applicable legal requirements. Like numbers refer to like elements throughout.

Cigarette rods are manufactured using a cigarette making machine, such as a conventional automated cigarette rod making machine. Exemplary cigarette rod making machines are of the type commercially available from Molins PLC or Hauni-Werke Korber & Co. KG. For example, cigarette rod making machines of the type known as MkX (commercially available from Molins PLC) or PROTOS (commercially available from Hauni-Werke Korber & Co. KG) can be employed. The components and operation of conventional automated cigarette making machines will be readily apparent to those skilled in the art of cigarette making machinery design and operation. The automated cigarette making machines of the type set forth herein may provide a formed continuous cigarette rod or smokable rod that can be subdivided into formed smokable rods of desired lengths.

Filtered cigarettes incorporating filter elements provided from filter rods that are produced in accordance with the present disclosure can be manufactured using traditional types of cigarette making techniques. For example, so-called "six-up" filter rods, "four-up" filter rods and "two-up" filter rods that are of the general format and configuration conventionally used for the manufacture of filtered cigarettes can be handled using conventional-type or suitably modified cigarette rod handling devices, such as tipping devices available as Lab MAX, MAX, MAX S or MAX 80 from Hauni-Werke Korber & Co. KG. The operation of those types of devices will be readily apparent to those skilled in the art of automated cigarette manufacture. Various types of cigarette components, including tobacco types, tobacco blends, top dressing and casing materials, blend packing densities; types of paper wrapping materials for tobacco rods, types of tipping materials, and levels of air dilution, can be employed.

Cigarette filter rods that are produced in accordance with the present disclosure can be used to provide multi-segment filter rods. Such multi-segment filter rods can be employed for the production of filtered cigarettes possessing multi-segment filter elements. An example of a two-segment filter element is a filter element possessing a first cylindrical segment incorporating activated charcoal particles (e.g., a "dalmation" type of filter segment) at one end, and a second cylindrical segment that is made from a filter rod produced in accordance with embodiments of the present disclosure. The production of multi-segment filter rods can be carried out using the types of rod-forming units that have been employed to provide multi-segment cigarette filter components. Multi-segment cigarette filter rods can be manufactured using a cigarette filter rod making device available under the brand name Mulfi from Hauni-Werke Korber & Co. KG of Hamburg, Germany.

Filter rods can also be manufactured pursuant to embodiments of the present disclosure using a rod-making apparatus, and an exemplary rod-making apparatus includes a rod-forming unit. Representative rod-forming units are available as KDF-2 and KDF-3E from Hauni-Werke Korber & Co. KG; and as Polaris-ITM Filter Maker from International Tobacco Machinery. Filter material, such as cellulose acetate filamentary tow, typically is processed using a conventional filter tow processing unit. For example, filter tow can be bloomed using bussel jet methodologies or threaded roll methodologies. An exemplary tow processing unit has been commercially available as E-60 supplied by Arjay Equipment Corp., Winston-Salem, N.C. Other exemplary tow processing units have been commercially available as AF-2, AF-3 and AF-4 from Hauni-Werke Korber & Co. KG. and as Candor-ITM Tow Processor from International Tobacco Machinery. Other types of commercially available tow processing equipment, as are known to those of ordinary skill in the art, can be employed. Other types of filter materials, such as gathered paper, nonwoven polypropylene web or gathered strands of shredded web, can also be provided.

Representative types of filter rods incorporating objects, and representative types of cigarettes possessing filter elements incorporating objects, such as flavor-containing capsules or pellets, can possess the types of components, according to both format and configuration, and can be manufactured using the types of techniques and equipment set forth, for example, in U.S. Pat. No. 7,740,019 to Nelson et al.; U.S. Pat. No. 7,115,085 to Deal, U.S. Pat. No. 4,862,905 to Green, Jr. et al., and U.S. Pat. No. 7,479,098 to Thomas et al.; which are incorporated herein by reference in their entireties.

Figure 1:
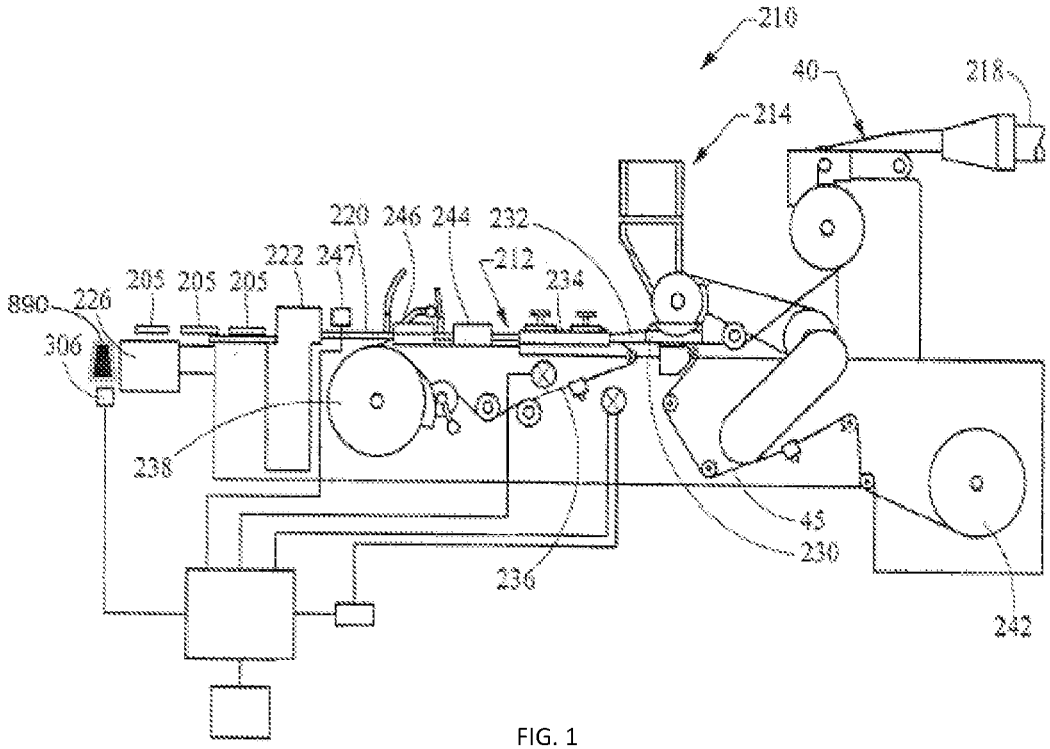
FIG. 1 is a schematic plan view of an apparatus for manufacturing a filter rod for a smoking article, according to one aspect of the present disclosure.

FIG. 1 schematically illustrates that filter rods or filter rod portions 205, each incorporating at least a portion of a plurality of microcapsule objects (i.e., a "group" of microcapsule objects), can be manufactured using a rod-making apparatus 210. An exemplary rod-making apparatus 210 includes a rod-forming unit 212 (e.g., a KDF-2 unit available from Hauni-Werke Korber & Co. KG) suitably adapted to process a continuous length of filter material 40 into a continuous filter rod 220. The continuous length or web of filter material is supplied from a source (not shown) such as a storage bale, bobbin, spool or the like. Generally, the filter material 40 is processed using a filter material processing unit 218 and passed through the rod-forming unit 212 to form the continuous rod 220. An object insertion unit 214 (i.e., an insertion unit) may be associated with the filter material processing unit 218 and/or the rod-forming unit 214 to place/insert the portion of microcapsule objects (not shown) within the continuous length of filter material or the continuous filter rod 220, respectively. In some instances, each portion of the inserted microcapsule objects may be configured as a discrete entity or group of such objects (i.e., each "group" may include x microcapsule objects, wherein x may vary as a function of the size of the individual microcapsule objects) such that, for example, discrete groups of microcapsule objects may be provided at selected intervals along the continuous filter rod 220. In other instances, however, the microcapsule objects may be continuously inserted into and along the continuous filter rod 220. The continuous filter rod 220 can then be subdivided using a rod cutting assembly 222 (i.e., a rod-dividing unit) into the plurality of rod portions 205 each having at least a portion of the plurality of microcapsule objects disposed therein. The succession or plurality of rod portions 205 are collected for further processing in a collection device 226 which may be a tray, a rotary collection drum, conveying system, or the like. If desired, the rod portions can be transported directly to a cigarette making machine. In such a manner, in excess of 500 rod portions, each of about 100 mm in length, can be manufactured per minute.

The filter material 40 can vary, and can be any material of the type that can be employed for providing a tobacco smoke filter for cigarettes. Preferably a traditional cigarette filter material is used, such as cellulose acetate tow, gathered cellulose acetate web, polypropylene tow, gathered cellulose acetate web, gathered paper, strands of reconstituted tobacco, or the like. Especially preferred is filamentary tow such as cellulose acetate, polyolefins such as polypropylene, or the like. One preferred filter material that can provide a suitable filter rod is cellulose acetate tow having 3 denier per filament and 40,000 total denier. As another example, cellulose acetate tow having 3 denier per filament and 35,000 total denier can provide a suitable filter rod. As another example, cellulose acetate tow having 8 denier per filament and 40,000 total denier can provide a suitable filter rod. For further examples, see the types of filter materials set forth in U.S. Pat. No. 3,424,172 to Neurath; U.S. Pat. No. 4,811,745 to Cohen et al.; U.S. Pat. No. 4,925,602 to Hill et al.; U.S. Pat. No. 5,225,277 to Takegawa et al. and U.S. Pat. No. 5,271,419 to Arzonico et al.

Filamentary tow, such as cellulose acetate, is processed using a conventional filter tow processing unit 218 such as a commercially available E-60 supplied by Arjay Equipment Corp., Winston-Salem, N.C. Other types of commercially available tow processing equipment, as are known to those of ordinary skill in the art, may similarly be used. Normally a plasticizer such as triacetin is applied to the filamentary tow in traditional amounts using known techniques. Other suitable materials for construction of the filter element will be readily apparent to those skilled in the art of cigarette filter design and manufacture.

The continuous length of filter material 40 is pulled through a block 230 by the action of the rod-forming unit 212, and directed into a gathering region thereof, to form a cylindrical composite. The gathering region can have a tongue and horn configuration, a gathering funnel configuration, stuffer or transport jet configuration, or other suitable type of gathering mechanism. The tongue 232 provides for further gathering, compaction, conversion or formation of the cylindrical composite from block 230 into an essentially cylindrical (i.e., rod-like) shape whereby the continuously extending strands or filaments of the filter material extend essentially along the longitudinal axis of the cylinder so formed. The filter material 40, which has been compressed into the cylindrical composite, is continuously received into the rod-forming unit 212 to form the continuous filter rod 220. In conjunction with the formation of the continuous filter rod 220, the portion of the plurality of microcapsule objects may be inserted along the length of and within the web of filter material as that filter material is being formed into the continuous filter rod 220 and/or after the filter material is formed into the continuous filter rod 220 (i.e., at any point along the rod-forming unit 212 (or upstream or downstream thereof). However, the microcapsule objects may also be introduced into the filter material at other points in the process and this exemplary embodiment is not intended to be limiting in that regard. For example, in order to insert the microcapsule objects into the continuous filter rod, the rod-forming unit 212 may include an element-dividing mechanism (not shown) disposed upstream of the object insertion unit 214. In some instances, the element-dividing mechanism may be the object insertion unit 214 (or portion thereof) itself.

The cylindrical composite is fed into wrapping mechanism 234, which includes endless garniture conveyer belt 236 or other garniture mechanism. The garniture conveyer belt 236 is continuously and longitudinally advanced using an advancing mechanism 238, such as a ribbon wheel or cooperating drum, so as to transport the cylindrical composite through wrapping mechanism 234. The wrapping mechanism provides a strip of wrapping material 45 (e.g., non-porous paper plug wrap) to the outer surface of the cylindrical composite in order to produce a continuous wrapped filter rod 220.

Generally, the strip or web of wrapping material 45 is provided from rotatable bobbin 242. The wrapping material is drawn from the bobbin, is trained over a series of guide rollers, passes under block 230, and enters the wrapping mechanism 234 of the rod-forming unit. The endless garniture conveyer belt 236 transports both the strip of wrapping material and the cylindrical composite in a longitudinally extending manner through the wrapping mechanism 234 while draping or enveloping the wrapping material about the cylindrical composite.

The seam formed by an overlapping marginal portion of wrapping material has adhesive (e.g., hot melt adhesive) applied thereto at applicator region 244 in order that the wrapping material can form a tubular container for the filter material. Alternatively, the hot melt adhesive may be applied directly upstream of the wrapping material's entry into the garniture of the wrapping mechanism 234 or block 230, as the case may be. The adhesive can be cooled using chill bar 246 in order to cause rapid setting of the adhesive. It is understood that various other sealing mechanisms and other types of adhesives can be employed in providing the continuous wrapped rod.

The continuous wrapped rod 220 passes from the sealing mechanism and is subdivided (e.g., severed) at regular intervals at the desired, predetermined length using cutting assembly 222, which may include as a rotary cutter, a highly sharpened knife, or other suitable rod cutting or subdividing mechanism. It is particularly desirable that the cutting assembly does not flatten or otherwise adversely affect the cross-sectional shape of the rod. The rate at which the cutting assembly severs the continuous rod at the desired points is controlled via an adjustable mechanical gear train (not shown), or other suitable mechanism. The rate at which the microcapsule objects are inserted into the continuous web of filter material/continuous filter rod is in a direct relationship to the speed of operation of the rod-making machine. The object insertion unit 214 can be geared in a direct drive relationship to the drive assembly of the rod-making apparatus. Alternatively, the object insertion unit 214 can have a direct drive motor synchronized with the drive assembly of the rod-forming unit and feedback controlled by coupling with the object inspection mechanism 247 to adjust the insertion unit drive assembly should the object insertion location shift out of position. In light of the relationship of the rate of object insertion and the rod-making machine, embodiments of the present disclosure are also directed to increasing the production rate of the rod-making machine without adversely affecting the microcapsule object placement within the filter material.

According to one aspect of the present disclosure, frangible microcapsule objects may be associated with a carrier prior to insertion by an insertion unit into the continuous rod member 220. Associating the microcapsule objects with a carrier prior to insertion into the continuous rod member 220 may, for example, provide structural support or otherwise a cohesive assembly for facilitating a relatively clean and efficient insertion process, and may also aid in reducing the risk of damage to the microcapsule objects during the insertion process. In doing so, an appropriate insert forming unit 400 may be provided, wherein one such aspect is shown schematically in FIG. 2, and wherein such an insert forming unit 400 may be configured to engage the microcapsule objects 500 with the carrier 600. In some instances, the carrier may be provided in discrete units. As such, in those instances, the insert forming unit may be configured to engage a discrete group of the microcapsule objects with a respective discrete unit of the carrier (see, e.g., FIG. 4). In other instances, however, the carrier 600 may be configured as an essentially continuous member or unit. In such instances, the insert forming unit 400 may be configured to engage discrete groups of the microcapsule objects 500 with a continuous supply of the carrier 600 such that the groups are regularly spaced apart therealong. In still other instances, however, where the carrier is an essentially continuous member or unit, the insert forming unit may be configured to engage an essentially continuous supply of microcapsule objects with a continuous supply of the carrier such that the microcapsule objects are continuously disposed therealong (see, e.g., FIG. 5).

The carrier 600 may take many different appropriate forms. For example, the carrier may comprise one of a pouch member, a capsule member, a cartridge member, a strand, a tubular member, a continuous elongate member, a carrier matrix, a continuous strip member, a continuous corrugated member, and combinations thereof.

Figure 2:
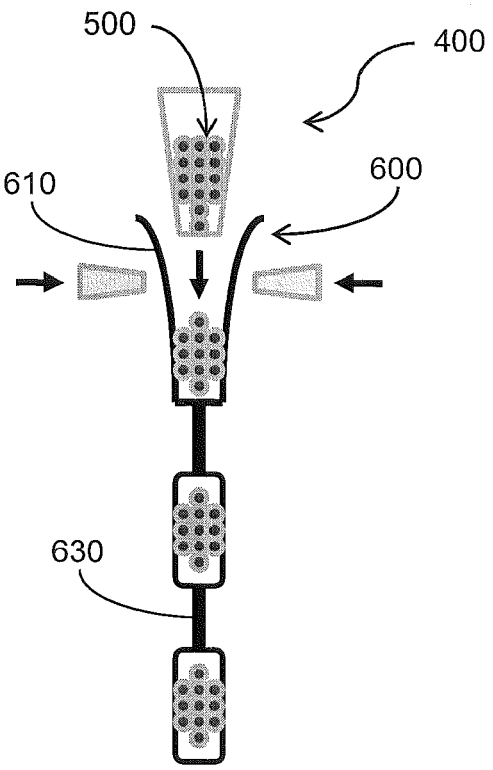
FIG. 2 is a schematic of an insert forming unit configured to associate at least a portion of a plurality of microcapsule objects with a carrier, for insertion thereof into a continuous filter rod element of a smoking article, according to one embodiment of the present disclosure.
Figure 2A:
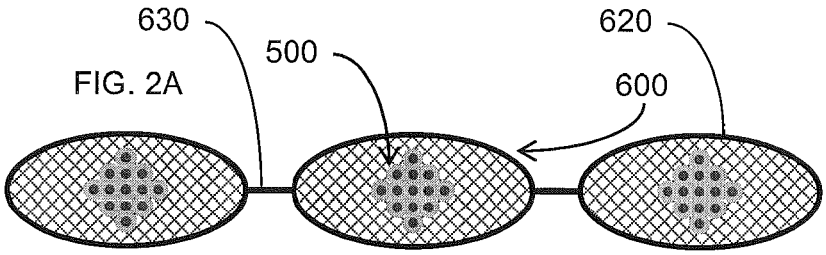
FIGS. 2A and 2B are schematics of a continuous carrier having at least a portion of a plurality of microcapsule objects associated therewith at discrete, spaced apart intervals therealong, according to one aspect of the present disclosure, for insertion into a continuous filter rod element of a smoking article.

In one aspect, as shown schematically in FIGS. 2 and 2A, the carrier 600 may comprise a pouch 620, and the insert forming unit 400 may be configured to form a plurality of discrete pouches 620 at regularly spaced intervals along a continuous tubular member 610 comprised of a pouch material. In doing so, the insert forming unit 400 may be further configured to deposit at least a portion of the plurality of microcapsule objects 500 in each pouch 620 during formation thereof. As such, the continuous tubular member 610 of pouch material (i.e., a mesh, a fabric, or any other suitable material, whether porous or not) may include longitudinally spaced-apart seals 630 extending laterally across the tubular member 610, wherein at least a portion of the plurality of microcapsule objects 500 may be disposed within the tubular member 610 between two longitudinally adjacent seals 630. Such sealed pouches 620 may be regularly spaced apart along the tubular member 610, wherein the longitudinal space between such sealed pouches may comprise, for instance, a portion of the tubular member not including any of the microcapsule objects disposed therein. Representative types of pouches, and pouch material or fleece, are set forth in U.S. Pat. No. 5,167,244 to Kjerstad, which is incorporated herein by reference. Such aspects involving pouch materials may be accomplished using a suitable apparatus as set forth, for example, in U.S. patent application Ser. No. 12/874,420, to Novak et al., filed Sep. 2, 2010, and incorporated herein in its entirety by reference.

In some aspects, such a pouch 620 may comprise a moisture permeable mesh material sealed shut at its opposed ends (e.g., by heat-sealing, a suitable adhesive, or other suitable sealing mechanism). The composition/construction of a moisture-permeable pouch may be varied. Suitable packets, pouches or containers of the type used for the manufacture of smokeless tobacco products are available under the tradenames CatchDry, Ettan, General, Granit, Goteborgs Rape, Grovsnus White, Metropol Kaktus, Mocca Anis, Mocca Mint, Mocca Wintergreen, Kicks, Probe, Prince, Skruf and TreAnkrare. Such a pouch provides a liquid-permeable container of a type that may be considered to be similar in character to the mesh-like type of material that is used for the construction of a tea bag.

Figure 2B:
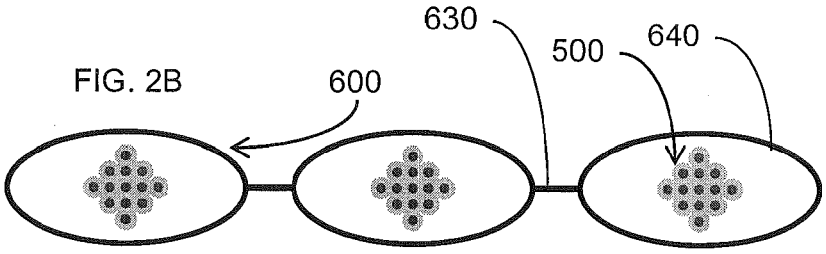

In a similar aspect, the carrier 600 may comprise a compartment 640 or otherwise a sealed "container," and the insert forming unit 400 may be configured to form a plurality of discrete compartments 640 at regularly spaced intervals along a continuous tubular member 610 comprised of a sheet material (i.e., a polymeric material, whether porous or not), as schematically shown in FIGS. 2 and 2B. In doing so, the insert forming unit 400 may be further configured to deposit at least a portion of the plurality of microcapsule objects 500 in each compartment 640 during formation thereof. As such, similarly to the aspect shown in FIG. 2A, the continuous tubular member 610 of sheet material may include longitudinally spaced-apart seals 630 extending laterally across the tubular member 610, wherein at least a portion of the plurality of microcapsule objects 500 may be disposed within the tubular member 610 between two longitudinally adjacent seals 630. Such sealed compartments 640 may be regularly spaced apart along the tubular member 610, wherein the longitudinal space between such sealed compartments 640 may comprise, for instance, a portion of the tubular member not including any of the microcapsule objects disposed therein.

Such exemplary pouches/compartments may be manufactured from materials, and in such a manner, such that during use by the user, the pouch/compartment undergoes a controlled dispersion or dissolution. Such materials may have the form of a mesh, screen, perforated paper, permeable fabric, or the like. For example, one material may be manufactured from a mesh-like form of rice paper, or perforated rice paper, which may dissolve in the mouth of the user. As a result, the microcapsule objects may undergo complete dispersion within the filter element during normal conditions of use. Other exemplary materials may be manufactured using water dispersible film forming materials (e.g., binding agents such as alginates, carboxymethylcellulose, xanthan gum, pullulan, and the like), as well as those materials in combination with materials such as ground cellulosics (e.g., fine particle size wood pulp). Some materials, though water dispersible or dissolvable, may be designed and manufactured such that under conditions of normal use, a significant amount of the contents of the microcapsule objects permeate through the material prior to the time that the pouch/compartment undergoes loss of its physical integrity. If desired, flavoring ingredients, disintegration aids, and other desired components, may be incorporated within, or applied to, the material.

Such a carrier, as previously disclosed, whether implementing a tubular member comprised of a pouch material or a sheet material, having the microcapsule objects incorporated therein may be produced, for example, using particular, suitably modified, "stick pack" vertical form-fill-seal pouch machines produced, for example, by Inever, Apex Korea, Leonhard, Visual Packaging LP, and Chung Shan Machinery. More particularly, such "stick pack" machines could be suitably modified to eliminate the separation of the filled pouches into individual stick packs. In such instances, the continuous tubular member may have regularly spaced pouches or compartments separated by an elongate lateral sealed area or an empty pouch/compartment sealed on opposing longitudinal ends thereof.

In some aspects, a suitably modified stick pack machine may be implemented to produce the continuous wrapped filter rod itself. For example, the tubular member may be comprised of a strip of wrapping material (e.g., non-porous paper plug wrap), wherein the formed paper "tube" may be filled in alternating sections or portions with microcapsules objects and filter material, such as cellulose acetate. An adhesive, such as cold glue or hot melt glue, could be applied to the plug wrap to form and seal the tubular member and/or to hold the filter material in place therein. In other instances, the plug wrap could be pre-coated with a heat activated adhesive. Of course, in so modifying the stick pack machine to directly form the continuous filter rod incorporating the microcapsule objects, the periodic lateral seals (i.e., flattened end seals common on standard "stick pack" packages) would not be used.

In still other aspects, a suitably modified stick pack machine may be implemented to produce discrete carrier units each having at least a portion of the plurality of microcapsule objects disposed therein. That is, in some instances, the carrier 600 may comprise a discrete unit, such as an individual pouch or compartment (see, e.g., FIG. 3), as previously disclosed, or a container member 700 such as a capsule member or cartridge member (see, e.g., FIG. 4). In such instances, the insert forming unit 400 may be configured to engage a discrete group of the microcapsule objects 500 with a respective discrete unit of the carrier or container member 700. In instances of discrete units of the carrier/container member, the insertion unit may further comprises an insertion facilitation device configured to interact with the carrier unit/container member to direct the carrier unit/container member having the at least a portion of the plurality of microcapsule objects therein into the rod member using a force greater than a gravitational force. That is, the insertion unit may be configured, for example, to implement pneumatic pressure or any other suitable motivational force to actively urge the carrier unit/container member into the continuous rod member during the insertion process. Such insertion of discrete units into a filter rod member may be accomplished, for example, using apparatuses and methods as disclosed in U.S. Pat. No. 7,972,254 to Stokes et al. and U.S. Pat. App. Pub. No. 2010/0101589 to Nelson et al.; both of which are incorporated herein in their entirety by reference. Accordingly, details of such apparatuses and methods as directed to discrete unit insertion into filter rod members are not addressed in detail herein for brevity, but will be appreciated by one skilled in the art.

In any instance, a continuous carrier member 600 having such longitudinally spaced-apart pouches/compartments 620, 640 each having microcapsule objects 500 disposed therein may be inserted into the continuous filter rod 220, as previously disclosed. That is, the insertion unit 214 may be configured to insert a continuous supply of the carrier carrying the microcapsule objects into the continuous supply of a filter material such that the continuous rod member includes the carrier and associated microcapsule objects therein. Such insertion of a continuous carrier member into a continuous filter rod may be accomplished in different manners, as will be appreciated by one skilled in the art, wherein such an insertion process may be disclosed, for example, in U.S. Pat. No. 7,740,019 to Nelson et al. As such, the resulting continuous filter rod 220 may be appropriately subdivided into filter elements 205 such that each filter element includes at least a portion of the carrier having at least a portion of the plurality of microcapsule objects disposed therein.

According to additional aspects of the present disclosure, the continuous carrier member 600 may take many different fonus. For example, in some instances, the carrier may comprise a continuous corrugated member 740 (i.e., a continuous sheet member having a sinusoidal profile with regularly spaced peaks and troughs) as shown, for example, in FIG. 5. In such instances, the insert forming unit 400 may be configured to deposit at least a portion of the plurality of microcapsule objects 500 into regularly-spaced troughs 750 along a continuous corrugated member 740. If necessary or desired, the continuous corrugated member 740 may have, for example, an appropriate adhesive material (not shown) disposed within the troughs 750 thereof so as to facilitate retention of the microcapsule objects 500 therein.

In other instances, the carrier may comprise, for example, a continuous sheet member and, more particularly, a flat sheet member, schematically represented as element 800 in FIG. 6. In such instances, the insert forming unit 400 may be configured to continuously deposit at least a portion of the plurality of microcapsule objects 500 along a continuous sheet member 800. In some particular aspects, the sheet member 800 may have an adhesive material (not shown) associated therewith, such that the at least a portion of the plurality of microcapsule objects 500 adhere thereto. The microcapsule objects 500 may be continuously deposited along the continuous sheet member 800, such that the microcapsule objects 500 form a layer extending therealong without definable breaks or interruptions. In other instances, however, the microcapsule objects 500 may be continuously deposited along the continuous sheet member 800 in discrete, spaced apart groups, each comprising at least a portion of the plurality of microcapsule objects 500, as shown, for example, in FIG. 7.

In similar aspects, the carrier may comprise, for example, a continuous web member (i.e., cellulose acetate filter tow) as shown, for example, as element 850 in FIG. 8. In such aspects, the insert forming unit 400 may be configured to continuously deposit at least a portion of the plurality of microcapsule objects 500 into interaction with a continuous web member 850 such that the at least a portion of the plurality of microcapsule objects 500 is dispersed and/or suspended therein. If necessary or desired, an adhesive material (not shown) may be associated with the continuous web member 850 to facilitate retention of the microcapsule objects therein once dispersed or otherwise distributed as desired. The microcapsule objects 500 may be continuously deposited along the continuous web member, such that the microcapsule objects are continuously dispersed therealong without definable breaks or interruptions. In other instances, however, the microcapsule objects 500 may be continuously deposited along the continuous web member 850 in discrete, spaced apart groups, each comprising at least a portion of the plurality of microcapsule objects, such that the microcapsules are essentially locally dispersed in spaced apart groups along the continuous web member. If necessary or desired, the insert forming unit 400 may be further configured to wrap the continuous web member 850 having the at least a portion of the plurality of microcapsule objects 500 dispersed therein about a continuous elongate rod member 860 or other appropriate structure, with the continuous elongate rod member 860 providing a support structure for the continuous web member 850, for example, during insertion thereof into the continuous rod member 220 (see, e.g., FIG. 9) In some instances, such an elongate rod member 860 may be configured to be non-effectual or minimally effectual with respect to the mainstream smoke drawn through the filter element. In still other instances, such an elongate rod member 860 may be configured to be degradable once the continuous web member having the at least a portion of the plurality of microcapsule objects dispersed therein is inserted into the continuous rod member 220.

In further similar aspects, the carrier may comprise, for example, a continuous strand member (i.e., a thread, a string, or other suitable filamentary member) as schematically represented, for example, as element 800 in FIG. 7. In such aspects, the insert forming unit 400 may be configured to continuously deposit at least a portion of the plurality of microcapsule objects 500 along a continuous elongate strand member 800. In some particular aspects, the elongate strand member may have an adhesive material (not shown) associated therewith, such that the at least a portion of the plurality of microcapsule objects adhere thereto. The microcapsule objects 500 may be continuously deposited along the continuous strand member, such that the microcapsule objects form a chain extending therealong without definable breaks or interruptions. In other instances, however, the microcapsule objects 500 may be continuously deposited along the continuous strand member in discrete, spaced apart groups, each comprising at least a portion of the plurality of microcapsule objects, so as to form a series of groups interconnected by the strand member.

During use, contact of the microcapsule objects with moisture present in the user's mouth may cause a microcapsule object to soften, lose its physical integrity, and release the flavoring ingredient(s) within the user's mouth. In other instances, the microcapsule object(s) may be purposefully crushed by application of pressure to release the flavoring ingredient(s). Such a release of flavoring ingredient may alter or enhance the flavor of the product or the smoke drawn therethrough, as well as extend the period of time that a user may enjoy the product. In certain instances, however, it may be necessary or desirable to include a provision in the continuous rod member 220 for facilitating deployment of the microcapsule objects for the intended purpose of altering the mainstream smoke drawn through the filter element. For example, in some instances, the relatively small size of the microcapsule objects my hinder rupture thereof to release the agent carried thereby. That is, it may be difficult for the smoker to rupture the microcapsule object by pressure applied by the smoker's fingers to the filter element including the microcapsule object. Interaction between adjacent microcapsule objects may facilitate rupture of one or more of the microcapsule objects in such instances, but may not always provide the solution.

As such, in some aspects, one of the insertion unit 214 and the insert forming unit 400 may be further configured to associate a rupture-facilitating device 880 (see, e.g., FIG.

10) with the microcapsule objects in the continuous rod member 220/filter element, wherein the rupture-facilitating device 880 may be configured to facilitate rupture of at least a portion of the microcapsule objects upon interaction therebetween. For instance, an "anvil" or other suitable relatively-hard object may be inserted into the continuous rod member 220/filter element as the rupture-facilitating device so as to be disposed among or adjacent to the microcapsule objects 500. In such instances, the smoker would exert pressure on the microcapsule object, wherein the pressure would be opposed by the relatively-hard object in order to facilitate rupture of the microcapsule object. For example, in some aspects, the elongate rod member 860, previously disclosed, may be appropriately configured as the relatively hard object opposing the pressure against the microcapsule object(s), as shown, for instance, in FIGS. 9A and 9B. FIG. 9A schematically illustrates one example where the elongate rod member 860 extends through an entire rod portion 205 (and/or continuously through the continuous wrapped rod 220), while FIG. 9B schematically illustrates that the elongate rod member 860 may extend through a segment 205*a* of a rod portion 205 (i.e., as a part of a multi-component or multi-segment filter element), in each instance with the elongate rod member 860 functioning as the rupture-facilitating device 880 or "anvil."

In other instances, the rupture-facilitating device may comprise, for example, an abrasive fabric having sufficient rigidity for the smoker to rupture the microcapsule object(s) through an abrasive interaction therewith. One skilled in the art will appreciate, however, that the particular nature of the rupture-facilitating device may be related to various factors such as, for example, the wall thickness of the microcapsule objects, the size(s) thereof, the particular payload carried thereby, or the like. As such, the nature and structure of the rupture-facilitating device 880, if included, may vary considerably from the examples disclosed herein.

In some aspects, it may be desirable for the microcapsule objects to be released from or otherwise independent of the carrier once inserted into the filter rod member. In such instances, a releasing unit 890 (see, e.g., FIG. 1) may be configured to release the microcapsule objects 500 from the carrier 600, once the carrier and associated microcapsule objects are disposed within the rod member. In doing so, the releasing unit 890 may be configured to one of dissolve, disintegrate, and degrade the carrier to release the microcapsule objects therefrom. In arrangements involving an adhesive interacting between the microcapsule objects and the carrier, the releasing unit 890 may be configured to release, dissolve, or otherwise deactivate the adhesive to free the microcapsule objects from the carrier.

Due, for example, to the mechanical nature of the insertion process, including the handling of the microcapsule objects with respect to engagement thereof with the carrier, as well as inserting the assembly into the filter rod member 220, it may be desirable in some aspects to have the capability of inspecting the microcapsule objects within the filter rod member upon completion of the insertion process. Accordingly, in some instances, an inspection unit 306 (see, e.g., FIG. 1) may be provided and arranged to inspect the rod member having the carrier and microcapsule objects therein. In one particular aspect, the inspection unit 306 may be configured to determine whether the frangible microcapsule objects have remained intact upon insertion into the rod member. In instances where the capsules are filled with a liquid payload, the inspection unit 306 may comprise a moisture sensor or other appropriate sensor configured to determine whether any of the microcapsule objects were ruptured during the insertion process, or are otherwise defective. One skilled in the art will appreciate, however, that any such inspection system or unit may be capable of inspecting other aspects of the microcapsule objects inserted within the filter rod member. For instance, such an inspection unit may be configured to determine, for example, the number of microcapsule objects disposed within the filter rod member, the distribution of the microcapsule objects, the disposition/alignment of the group of the microcapsule objects, and/or the state of the carrier and/or any adhesive which may be associated therewith.

Microcapsule objects of the type disclosed herein may include an outer shell incorporating a material such as wax, and an inner payload incorporating an aqueous or non-aqueous liquid (e.g., a solution or dispersion of at least one flavoring ingredient within water or an organic liquid such as an alcohol or oil, or a mixture of water and a miscible liquid like alcohol or glycerin). Exemplary flavoring agents that can be encapsulated within the microcapsule objects for incorporation within the filter element can be natural or synthetic, and the character of these flavors can be described, without limitation, as fresh, sweet, herbal, confectionary, floral, fruity or spice. Specific types of flavors include, but are not limited to, vanilla, coffee, chocolate, cream, mint, spearmint, menthol, peppermint, wintergreen, lavender, cardamom, nutmeg, cinnamon, clove, cascarilla, sandalwood, honey, jasmine, ginger, anise, sage, licorice, lemon, orange, apple, peach, lime, cherry, and strawberry. See also, Leffingwill et al., Tobacco Flavoring for Smoking Products, R. J. Reynolds Tobacco Company (1972). Flavorings also can include components that are considered moistening, cooling or smoothening agents, such as eucalyptus. These flavors may be provided neat (i.e., alone) or in a composite (e.g., spearmint and menthol, or orange and cinnamon). Composite flavors may be combined in a single microcapsule object as a mixture, or as components of multiple microcapsule objects. Preferably, the microcapsule objects do not incorporate any tobacco within their outer shells, or within their inner payload regions. However, if desired, other embodiments of microcapsule objects may incorporate tobacco (e.g., as finely group tobacco pieces and/or tobacco extracts) within their outer shells and/or within their inner payload regions. See, for example, U.S. Pat. No. 7,836,895 to Dube et al.

In some aspects, the payload is a mixture of a flavoring agent and a diluting agent or carrier. The preferred diluting agent is a triglyceride, such as a medium chain triglyceride, and more particularly a food grade mixture of medium chain triglycerides. See, for example, Radzuan et al., Porim Bulletin, 39, 33-38 (1999). The amount of flavoring and diluting agent within the microcapsule object may vary. In some instances, the diluting agent may be eliminated altogether, and the entire payload can be composed of flavoring agent. Alternatively, the payload can be almost entirely comprised of diluting agent, and only contain a very small amount of relatively potent flavoring agent. In one embodiment, the composition of the mixture of flavoring and diluting agent is in the range of about 5 percent to about 75 percent flavoring, and more preferably in the range of about 5 to about 25 percent flavoring, and most preferably in the range of about 10 to about 15 percent, by weight based on the total weight of the payload, with the balance being diluting agent.

The crush strength of the microcapsule objects is sufficient to allow for normal handling and storage without significant degree of premature or undesirable breakage. The crush strength of the microcapsule objects also is sufficiently low so as to allow the smoker to readily break in a purposeful manner during use of the cigarette a significant number of the microcapsule objects within the filter element. In other instances, however, the rupture-facilitating device may be provided, if necessary or desired. Providing microcapsule objects that possess both suitable integrity and ability to rupture can be determined by experimentation, depending upon factors such as capsule size and type, and may be a matter of design choice. See, for example, U.S. Pat. No. 7,479,098 to Thomas et al., which is incorporated herein by reference.

Preferred cigarettes of the present disclosure exhibit desirable resistance to draw. For example, an exemplary cigarette exhibits a pressure drop of between about 50 and about 200 mm water pressure drop at 17.5 cc/sec. air flow. Preferred cigarettes exhibit pressure drop values of between about 60 mm and about 180, more preferably between about 70 mm to about 150 mm, water pressure drop at 17.5 cc/sec. air flow. Typically, pressure drop values of cigarettes are measured using a Filtrona Cigarette Test Station (CTS Series) available form Filtrona Instruments and Automation Ltd.

Filter elements of the present disclosure can be incorporated within the types of cigarettes set forth in U.S. Pat. No. 4,756,318 to Clearman et al.; U.S. Pat. No. 4,714,082 to Banerjee et al.; U.S. Pat. No. 4,771,795 to White et al.; U.S. Pat. No. 4,793,365 to Sensabaugh et al.; U.S. Pat. No. 4,989,619 to Clearman et al.; U.S. Pat. No. 4,917,128 to Clearman et al.; U.S. Pat. No. 4,961,438 to Korte; U.S. Pat. No. 4,966,171 to Serrano et al.; U.S. Pat. No. 4,969,476 to Bale et al.; U.S. Pat. No. 4,991,606 to Serrano et al.; U.S. Pat. No. 5,020,548 to Farrier et al.; U.S. Pat. No. 5,027,836 to Shannon et al.; U.S. Pat. No. 5,033,483 to Clearman et al.; U.S. Pat. No. 5,040,551 to Schlatter et al.; U.S. Pat. No. 5,050,621 to Creighton et al.; U.S. Pat. No. 5,052,413 to Baker et al.; U.S. Pat. No. 5,065,776 to Lawson; U.S. Pat. No. 5,076,296 to Nystrom et al.; U.S. Pat. No. 5,076,297 to Farrier et al.; U.S. Pat. No. 5,099,861 to Clearman et al.; U.S. Pat. No. 5,105,835 to Drewett et al.; U.S. Pat. No. 5,105,837 to Barnes et al.; U.S. Pat. No. 5,115,820 to Hauser et al.; U.S. Pat. No. 5,148,821 to Best et al.; U.S. Pat. No. 5,159,940 to Hayward et al.; U.S. Pat. No. 5,178,167 to Riggs et al.; U.S. Pat. No. 5,183,062 to Clearman et al.; U.S. Pat. No. 5,211,684 to Shannon et al.; U.S. Pat. No. 5,240,014 to Deevi et al.; U.S. Pat. No. 5,240,016 to Nichols et al.; U.S. Pat. No. 5,345,955 to Clearman et al.; U.S. Pat. No. 5,396,911 to Casey, III et al.; U.S. Pat. No. 5,551,451 to Riggs et al.; U.S. Pat. No. 5,595,577 to Bensalem et al.; U.S. Pat. No. 5,727,571 to Meiring et al.; U.S. Pat. No. 5,819,751 to Barnes et al.; U.S. Pat. No. 6,089,857 to Matsuura et al.; U.S. Pat. No. 6,095,152 to Beven et al; and U.S. Pat. No. 6,578,584 Beven; which are incorporated herein by reference. For example, filter elements of the present disclosure can be incorporated within the types of cigarettes that have been commercially marketed under the brand names "Premier" and "Eclipse" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000); which are incorporated herein by reference.

One skilled in the art will also appreciate that the microcapsule objects referenced herein may be exemplary of a general micro-scale object that may benefit from the disclosure herein with respect to insertion into a filter element of a smoking article. For instance, other micro-scale objects which may be applied according to the disclosure herein include, for example, beads, pellets, rods, or other shaped items or combinations thereof designed to deliver a predetermined, concentrated amount of a smoke-altering ingredient to the user. In some examples, representative types of materials and ingredients useful for the manufacture of essentially water insoluble flavored beads, strands or pellets may be found within the filters of cigarettes available as Camel Dark Mint, Camel Mandarin Mint, Camel Spice Crema, Camel Izmir Stinger, Camel Spice Twist, Camel Mandalay Lime and Camel Aegean Spice by R. J. Reynolds Tobacco Company. The micro-scale object preferably is shaped and of a texture that provides for comfortable and convenient use.

Many modifications and other aspects of the disclosure set forth herein will come to mind to one skilled in the art to which this disclosure pertains having the benefit of the teachings presented in the foregoing descriptions and the associated drawings. For example, in some instances, the microcapsule objects may be inserted directly into the continuous rod member 220/filter element, without being associated with a "carrier" as otherwise disclosed herein. As previously disclosed, an insertion facilitation device 400 may be configured to interact with the carrier unit/container member to direct the carrier unit/container member having the at least a portion of the plurality of microcapsule objects therein into the rod member using a force greater than a gravitational force. That is, the insertion unit may be configured, for example, to implement pneumatic pressure or any other suitable motivational force from a source 900 to actively urge the carrier unit/container member into the continuous rod member during the insertion process (see, e.g., FIG. 11).

In some aspects, such a concept may similarly be implemented with respect to the microcapsule objects themselves. That is, the microcapsule objects may, in some instances, be inserted directly into the continuous rod member 220. In order to accomplish such insertion of microcapsule objects, an appropriately modified apparatus may be implemented of the type disclosed, for example, in U.S. Pat. Nos. 7,115,085; 7,654,945; and 7,833,946 to Deal or U.S. patent application Ser. No. 12/874,420, to Novak et al., filed Sep. 2, 2010.

More particularly, in order to directly insert the microcapsule objects into the continuous rod member, an appropriate apparatus for forming a cigarette filter rod member defining a longitudinal axis, may include a rod-forming unit configured to form a continuous supply of a filter material into a continuous cylindrical rod member; and an insertion unit configured to introduce a plurality of frangible microcapsule objects directly into the rod member at discrete locations therealong. In one aspect, such an insertion unit 950 (see, e.g., FIG. 11) may comprise a repository 960 configured to contain a plurality of microcapsule objects 500, wherein the repository may be in communication with at least one tapered channel (i.e., a funnel member), as shown, for example, as element 970 in FIG. 11, extending therefrom toward the rod member 220. In such instances, the at least one tapered channel 970 may be configured to deliver a discrete group of at least a portion of the plurality of microcapsule objects from the repository 960 directly into the rod member at one of the discrete locations therealong. That is, the insertion unit may be configured to deliver a metered amount of the microcapsule objects from the repository (i.e., a hopper) and through the at least one tapered channel (i.e., a funnel) directed into the rod member as a charge or discrete group of such microcapsule objects. If necessary or desired, a motivating force such as, for example, a pneumatic charge from a source 900, may be applied through the at least one tapered channel 970 in order to urge the discrete group of such microcapsule objects into the continuous rod member 220.

In other aspects, the insertion unit may comprise a repository 1000 (i.e., a hopper) for receiving the plurality of microcapsule objects, and defining a plurality of cavities 1002 arranged in a substantially circular formation, as shown in FIG. 12. An arm member 1004 may be operably engaged with the repository 1000 and configured to be rotatable therein to direct at least a portion of the plurality of microcapsule objects within the repository into the cavities 1002. A charge delivery device 1006 may be operably engaged with the repository 1000 and configured to serially engage each cavity 1002 defined thereby to direct the at least a portion of the microcapsule objects therefrom directly into the rod member at one of the discrete locations therealong. Such an insertion unit may be provided through suitable modification of the type of apparatus disclosed, for example, in U.S. patent application Ser. No. 12/874,420, to Novak et al. (directed to an apparatus and method for directing one or more objects into a snus pouch), filed Sep. 2, 2010, the contents of which are incorporated herein in their entirety by reference.

In yet other aspects, the insertion unit may comprise a repository (i.e., a hopper) configured to contain the plurality of microcapsule objects. The repository may be in communication with at least one pneumatic delivery device extending therefrom toward the rod member, wherein the at least one pneumatic delivery device may be configured receive at least a portion of the microcapsule objects and to deliver a discrete group of the at least a portion of the plurality of microcapsule objects, using pneumatic pressure (i.e., pneumatic "direct injection" tubes) from source 900 (see, e.g., FIG. 11) directly into the rod member 220 at one of the discrete locations therealong.

In any instance, aspects of the present disclosure are particularly configured to provide microcapsule objects and to place discrete groups of such microcapsule objects within a continuous cigarette filter rod member, at discrete locations therealong, such that a desired arrangement of a discrete group of at least a portion of a plurality of microcapsule objects per cigarette filter element portion of the rod member is obtained when the continuous cigarette filter rod member is subdivided to form discrete filter element portions.

Therefore, it is to be understood that the disclosure is not to be limited to the specific aspects disclosed and that modifications and other aspects are intended to be included within the scope of the appended claims. Although specific terms are employed herein, they are used in a generic and descriptive sense only and not for purposes of limitation.

That which is claimed:

1. A method of forming a cigarette filter rod member defining a longitudinal axis, the method comprising:

forming a continuous supply of a filter material into a continuous cylindrical rod member using a rod-forming unit;

engaging a plurality of frangible microcapsule objects with a carrier using an insert forming unit by depositing at least a portion of the plurality of microcapsule objects into regularly-spaced troughs along a continuous corrugated member; and inserting the carrier carrying the plurality of frangible microcapsule objects into the rod member using an insertion unit.

2. A method of forming a cigarette filter rod member defining a longitudinal axis, the method comprising:

forming a continuous supply of a filter material into a continuous cylindrical rod member using a rod-forming unit;

engaging a plurality of frangible microcapsule objects with a carrier using an insert forming unit;

associating a rupture-facilitating device with the microcapsule objects, the rupture-facilitating device being configured to facilitate rupture of at least a portion of the microcapsule objects upon interaction therebetween; and inserting the carrier carrying the plurality of frangible microcapsule objects into the rod member using an insertion unit.

3. The method according to claim 1, further comprising inspecting the rod member having the carrier and microcapsule objects therein using an inspection unit, the inspection unit being configured to determine whether the frangible microcapsule objects have remained intact upon insertion into the rod member.

4. The method according to claim 3, wherein inspecting the rod member having the carrier and microcapsule objects therein further comprises inspecting the rod member having the carrier and microcapsule objects therein using a moisture sensor.

* * * * *